US005628573A

United States Patent [19]

Selke

[11] Patent Number: 5,628,573

[45] Date of Patent: May 13, 1997

[54] DOCUMENT BRAKE FOR DOCUMENT PROCESSING DEVICES

[75] Inventor: Reimund Selke, Paderborn, Germany

[73] Assignee: Siemens Nixdorf Informationssysteme Aktiengesellschaft, Paderborn, Germany

[21] Appl. No.: 522,240

[22] PCT Filed: Feb. 2, 1994

[86] PCT No.: PCT/DE94/00099

§ 371 Date: Sep. 6, 1995

§ 102(e) Date: Sep. 6, 1995

[87] PCT Pub. No.: WO94/20934

PCT Pub. Date: Sep. 15, 1994

[30] Foreign Application Priority Data

Mar. 11, 1993 [DE] Germany ..... 9303582 U

[51] Int. Cl.[6] ..... B41J 13/00

[52] U.S. Cl. ..... 400/578; 400/679

[58] Field of Search ..... 400/578, 605, 400/679, 680, 691, 641

[56] References Cited

U.S. PATENT DOCUMENTS 5,320,437 6/1994 Malke et al. ..... 400/605

5,364,196 11/1994 Baitz et al. ..... 400/691

FOREIGN PATENT DOCUMENTS 30 29 460 A1 6/1982 Germany .

38 36 604 A1 5/1990 Germany .

WO91/13765 9/1991 WIPO .

OTHER PUBLICATIONS

IBM Technical Disclosure Bulletin, vol. 17, No. 5, Oct. 1974, J.A. Craft, "Paper Bin", p. 1308.

*Primary Examiner*—John S. Hilten

*Assistant Examiner*—Anthony H. Nguyen

*Attorney, Agent, or Firm*—Hill, Steadman & Simpson

[57] ABSTRACT

Document processing device, especially a document printer (10, 110), has a document issuing section which has a slit-like document issuing aperture (28) and a document support (16, 116) arranged downstream of the latter in the document issuing direction. There is arranged on the document support ( 16, 116), parallel to the document issuing aperture (28), a region (50, 150) which inhibits the sliding of a document and projects beyond at least parts (42, 142) of the document support (16, 116).

15 Claims, 2 Drawing Sheets

E
10
12
14
16
18
20
20'
22
24
26
28
30
32
34
36
38
40
42
44
46
48
50
d1

DOCUMENT BRAKE FOR DOCUMENT PROCESSING DEVICES

BACKGROUND OF THE INVENTION

The invention relates to a document processing device, especially a document printer, with a document issuing section which has a slot-like document issuing aperture and a document support arranged downstream of the latter in the document issuing direction.

Document processing devices of this type are, for example, document reading or printing devices. Within such a device, a document is taken past the processing station by transporting means. As it is transported, it is held securely, for example between pairs of rollers. After its processing, the document is pushed by the transporting device out of the issuing aperture onto the document support, where it can be removed manually by the operator. A device of this type is known for a printer from the reference WO 91/13765 (corresponding to U.S. Pat. Nos. 5,320,437 and 5,364,196).

To achieve a high processing rate, the documents are conveyed at high speed. As a result, when they leave the transporting device they receive such a thrust that they shoot far out of the issuing aperture. Long documents in particular then tend to fall from the document support, because their center of gravity ends up in front of the edge of the housing.

IBM Technical Disclosure Bulletin Vol. 17, No. 5, October 1974, page 1308 discloses a paper-receiving container into which sheets of paper are conveyed at high speed. On leaving a transporting device, the sheets butt against a flap of flexible material which protrudes from above into the transporting path and serves the purpose of absorbing some of the kinetic energy of the sheet of paper.

SUMMARY OF THE INVENTION

It is the object of the invention to prevent issued documents from falling from the document support of a document processing device.

This object is achieved by a document processing device of the present invention, especially a document printer, having a document issuing section which has a slot-like document issuing aperture and a document support section arranged downstream of the latter in the document issuing direction. There is arranged on the document support section, parallel to the document issuing aperture, a slide inhibiting region which inhibits the sliding of a document and projects beyond at least parts of the document support. An upper border of a front wall of a lower housing part adjacent to the document support surface forms part of the document support section. A set off of the document support section is formed on this housing border, the surface of which set off is set back by a distance, preferably 0.5–3 mm, below the remaining document support surface.

The invention is based on the observation that issued documents slide on an air cushion over the document support, so their coefficient of friction with respect to the support surface is low. The application of a slide-inhibiting means to the support surface would also do nothing to change this. Only a raising of the smooth support surface interrupts the carrying layer of air and the documents lands on this surface, with the result that a slide-inhibiting means on the support can become effective. A particularly good braking effect is achieved if the region projecting beyond the support surface has a slide-inhibiting surface. In this case, this region is to have the same coefficient of friction throughout and be parallel to the document issuing aperture, that is to say also parallel to the leading document edge, in order to avoid any canting of the document.

In the case of document processing devices in which documents are fed in and issued through the same aperture, that is to say in which the document entering aperture is identical to the document issuing aperture, documents to be fed in are usually placed initially on the document support and are then pushed into the document entering aperture until they are taken up by the transporting device. A slide-inhibiting region on the document support hinders the manual pushing in of the document. In the case of document processing devices of this type, the slide-inhibiting region is preferably arranged close to the housing edge facing the operator and parallel to this edge. The remaining surface of the document support close to the entry aperture is in this case to have a substantially lower coefficient of friction. The operator can then easily reach over the region of high sliding inhibition and exert on the document the pressure of his hand, effecting the pushing forward, in the region of the low coefficient of friction.

The slide-inhibiting region projecting beyond the document support expediently has the width of the latter. Consequently, documents of any desired width can be processed. If documents of only one width or of few different widths are to be processed, circular elevations, so-called bosses, which lie close to the edges of the documents suffice. Regions lying in between then have the low coefficient of friction, which further facilitates the feeding in of documents.

The raised region may be formed integrally with the document support: in the case of a support formed from a plate, by embossing a beading or hollows from the underside, in the case of a plastics injection molding by corresponding designing of the injection mold.

The slide-inhibiting action can be achieved by roughening or by coating with a granular material or a plastic of a high coefficient of friction.

The raised region may also be formed by a profiled strip made of rubber or plastic which is placed into a groove in the document support or is adhesively bonded onto the latter. In this case, the profiled strip advantageously lies in the region of a setoff, set back from the support surface by a small amount—preferably 0.5–3 mm—which receives the edge of the profiled strip close to the issuing aperture. This has the effect of preventing a document butting against the lower edge of the profiled strip.

In a further refinement of the abovementioned arrangement, the upper housing edge is set back so far with respect to the document support surface that the profiled strip does not project beyond the latter. In this case, a document is not braked until it has shot so far over the support surface that it bends downward and thereby touches the profiled strip. In the case of this arrangement, the document feeding takes place without any hindrance of the operator.

Further advantageous characteristics of the invention are as follows.

The border of the document support remote from the document issuing aperture is adjacent to an edge of the device housing. The slide-inhibiting region is arranged close to the housing edge and parallel to the latter. The coefficient of friction of the slide-inhibiting region is large in comparison to the coefficient of friction of the remaining document support surface.

The slide-inhibiting region extends substantially over the width of the document support.

The region projecting beyond the document support surface is formed by boss-like elevations. The elevations projecting beyond the document support surface are integrally formed on the document support section.

The region projecting beyond the document support surface is a profiled strip. The profiled strip is adhesively bonded onto the document support section or the profiled strip is inserted in a groove in the document support section.

The profiled strip has an oval cross-sectional profile. Alternatively, the profiled strip has a fastening web which can be inserted into the groove and a mushroom head shaped upper part adjoining the fastening web. In this embodiment the upper part has a flatly rising flank, facing toward the profiled strip of the entering/issuing aperture in the installed position, and a flank lying opposite this rising flank and falling in the form of an arc of a circle towards the housing edge. The radius of the arc of a circle preferably corresponds to the radius of a neighboring housing edge.

The profiled strip consists of natural rubber and has a hardness of preferably 45 Shore A.

BRIEF DESCRIPTION OF THE DRAWINGS

The features of the present invention which are believed to be novel, are set forth with particularity in the appended claims. The invention, together with further objects and advantages, may best be understood by reference to the following description taken in conjunction with the accompanying drawings, in the several Figures of which like reference numerals identify like elements, and in which:

DESCRIPTION OF THE PREFERRED EMBODIMENTS

Figure 1:
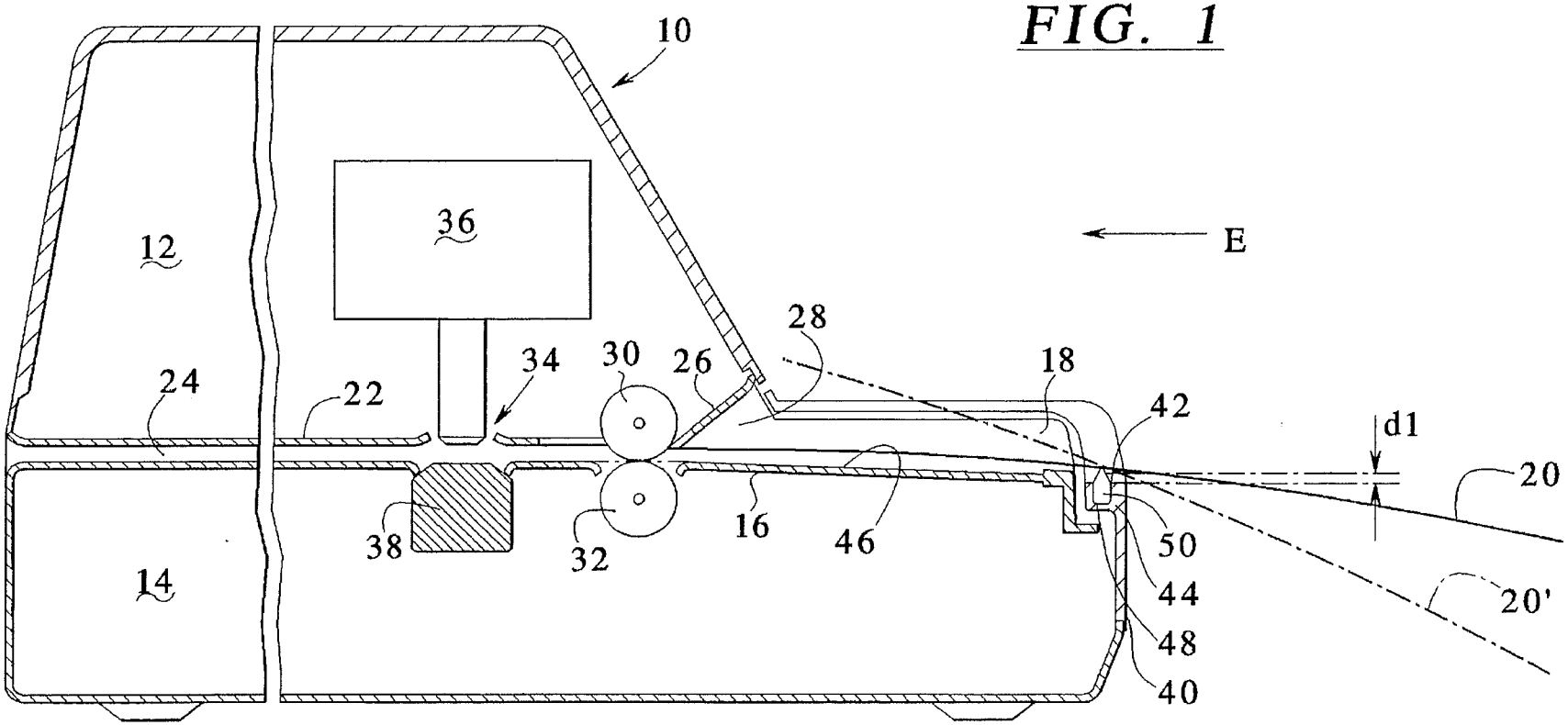
FIG. 1 shows a sectioned side view of a document printer with a first exemplary embodiment of the profiled strip

In FIG. 1, a document printer is denoted by 10. It has an upper housing part 12 and lower housing part 14. The upper housing part 12 leaves the front region of the lower housing part 14 exposed, which is then covered over at the top by a document support 16. At the side, the document support 16 is bounded by a document lay 18, which ensures a defined lateral position of the documents 20, 20'.

In the region of the upper housing part 12, a baffle 22 is arranged at a small distance from the document support 16 and parallel to the latter. Document support 16 and baffle 22 form a document transporting shaft 24. The front end 26 of the baffle 22 is bent away through about 45° from the document support 16, with the result that an entering/issuing aperture 28 narrowing in the form of a funnel forms with the latter.

Arranged directly downstream of the funnel, seen in document entering direction E, in the transporting shaft 24 is a pair of transporting rollers 30, 32. Downstream thereof is a printing station 34, which in a known way is formed by a needle printing head 36 and a printing abutment 38 and is therefore not described in any more detail.

The front wall 40 of the lower housing part 14 has, close to its upper border 42, a region 44 of greater wall thickness. The border 42 is set back with respect to the surface 46 of the document support 16 by an amount d1. An upwardly open groove 48, into which a profiled strip 50 of an oval cross-sectional profile is inserted, is made in the region 44. The part of the profiled strip 50 lying outside the groove 48 projects beyond the upper border 42 by the amount d1, thus lies approximately flush with the document support surface 46.

The mode of operation of the document printer represented in FIG. 1 is described below.

A document 20 to be processed is pushed by the operator manually in the direction of the arrow E over the document support 16 into the entering/issuing aperture 28, until it butts against the pair of rollers 30, 32. Thereupon, a drive motor (not shown) is switched on, which turns the transporting rollers 30, 32 in the sense of drawing the document in, whereby the document is conveyed into the printing station 34. After printing, the transporting rollers are driven at high speed in the ejecting direction. The document is thereby catapulted out from the pair of transporting rollers 30, 32 and thereby flies further on an air cushion over the document support 16 counter to the arrow direction E. A short document in this case loses speed so quickly that it still comes to rest safely on the document support. A long document, on the other hand, has already left the document support with its leading edge when its rear edge leaves the pair of transporting rollers 30, 32. Its own weight in this case makes it bow downward, as is shown for the document 20. It thereby comes into contact with the profiled strip 50, which brakes it so quickly to a standstill that its rear edge can still be supported on the baffle 22. Falling of the document 50 from the document support 16 is effectively prevented as a result. An unbraked document would tip over the housing edge 42 and fall from the document support 16. This is diagrammatically shown for a document 20' (shown by dot-dashed lines).

Figure 2:
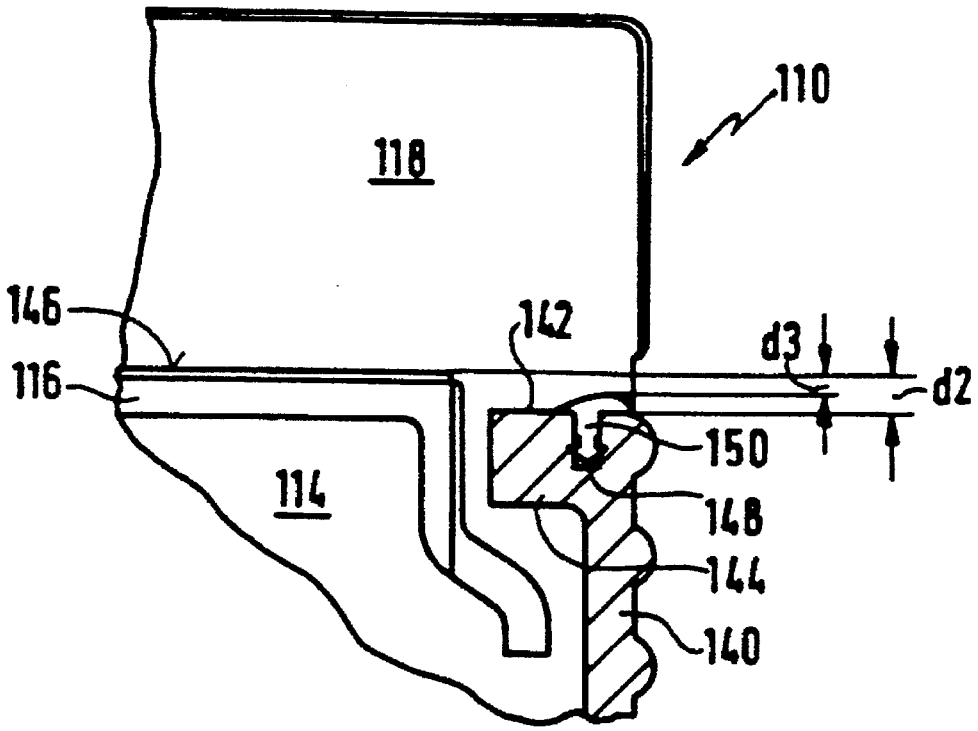
FIG. 2 shows a detail from FIG. 1 with a second exemplary embodiment of the profiled strip

FIG. 2 shows the parts relevant for the invention of a second exemplary embodiment of a document printer 110 in a sectioned side view. The following are shown: part of a document support 116, part of a lower housing part 114 with front wall 140, which has close to its upper border 142 a region 144 of greater wall thickness, into which an upwardly open groove 148 is made. A profiled strip 150 is inserted in said groove.

The upper border 142 is set back, in a way similar to in the case of the first exemplary embodiment shown in FIG. 1, with respect to the surface 146 of the document support 116 by an amount d2. Unlike in the first exemplary embodiment, however, the part of the profiled strip 150 protruding out of the groove 148 is set back with respect to the document support surface 146 by an amount d3.

The leading edge of a document ejected by the transporting rollers 30, 32 must in the case of the arrangement according to FIG. 2 first of all be conveyed beyond the edge of the upper border 142 by an amount determined by the physical properties of the document in order that it can be inclined so far downward that the document can be braked by the profiled strip 150. This arrangement has the advantage when introducing a document into the document printer 110 that the profiled strip 150 is not touched, thus its braking action does not come to bear.

Figure 3:
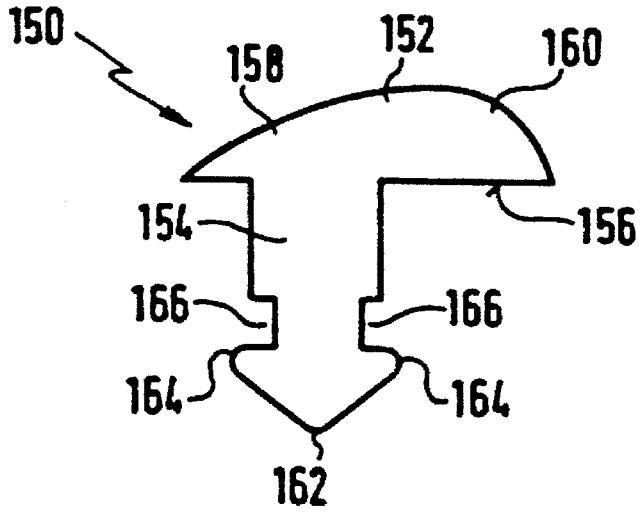
FIG. 3 shows a cross section through the profiled strip according to FIG. 2.

FIG. 3 shows the cross-sectional profile of the profiled strip 150 in the installed position (shown in FIG. 2) in the document printer 110. The profiled strip substantially comprises a mushroom head-like upper part 152, which protrudes beyond the groove 148, and a fastening web 154, engaging in the groove.

The underside of the upper part 152 forms a beating surface 156, which rests snugly on the upper edge 142 of the front housing wall 140 when the profiled strip is installed.

The flank 158 of the upper part 152 facing toward the entering/issuing aperture 28 (FIG. 1) rises with a flat angle with respect to the upper border 142, in order to ensure easy sliding of a document onto the profiled strip 150. The flank 160 of the upper part 152 facing away from the entering/issuing aperture has the form of an arc of a circle whose radius is adapted to the edge radii chosen on the printer housing for design reasons and technical demolding reasons.

The fastening web 154 tapers to a point at its lower end 162 and, close to the lower end, is provided on both sides with spreading webs 164 pointing away from the tip. Above these, clearances 166 are provided in the fastening web 154.

When inserting, the profiled strip 150 is simply to be introduced with its pointed end 162 into the groove 148 (FIG. 2). On pressing into the groove 148, the spreading webs 164 yield slightly in the direction of the clearances 166. The profiled strip is pressed into the groove 148 until its bearing surface 156 rests on the upper border 142 of the housing wail 140. For pulling the profiled strip 150 out of the groove 148, a significantly greater exertion of force is required, since the spreading webs 164 thereby spread out and jam against the walls of the groove 148.

Natural rubber of a hardness of about 45 Shore A has proven to be particularly suitable as a material for the profiled strip, because this material has a high coefficient of friction and, with this hardness, the profiled strip can be easily introduced into the groove, but on the other hand is retained securely therein.

The invention is not limited to the particular details of the apparatus depicted and other modifications and applications are contemplated. Certain other changes may be made in the above described apparatus without departing from the true spirit and scope of the invention herein involved. It is intended, therefore, that the subject matter in the above depiction shall be interpreted as illustrative and not in a limiting sense.

What is claimed is:

1. A document processing device, comprising:

a document issuing section having a slot-like document issuing aperture out of which a document is ejected in a document issuing direction;

a document support section arranged downstream of the document issuing section in the document issuing direction;

the document support section having a slide inhibiting region which inhibits sliding of the document, said slide inhibiting region being parallel to said document issuing aperture;

a lower housing part having a front wall with an upper border, said slide inhibiting region attached to said upper border and projecting beyond said upper border;

a document support surface on at least a portion of a top of said lower housing part, at least said document support surface and said upper border forming said document support section;

said upper border being offset from and lower than said document support surface by a predetermined offset distance.

2. The document processing device as claimed in claim 1, wherein the upper border of the document support section remote from the document issuing aperture is adjacent to a housing edge of the lower housing, and the slide-inhibiting region is arranged close to the housing edge and parallel to the housing edge, and wherein a coefficient of friction of the slide-inhibiting region is large in comparison with a coefficient of friction of the remaining document support surface.

3. The document processing device as claimed in claim 1, wherein the slide-inhibiting region extends substantially over a width of the document support section.

4. The document processing device as claimed in claim 1, wherein the slide inhibiting region is formed by boss-like elevations.

5. The document processing device as claimed in claim 4, wherein the elevations are integrally formed on the document support section.

6. The document processing device as claimed in claim 1, wherein the slide inhibiting region projecting beyond the document support surface is a profiled strip.

7. The document processing device as claimed in claim 6, wherein the profiled strip is adhesively bonded onto the document support section.

8. The document processing device as claimed in claim 6, wherein the profiled strip is inserted in a groove in the document support section.

9. The document processing device as claimed in claim 8, wherein the profiled strip has a substantially oval cross-sectional profile.

10. The document processing device as claimed in claim 8, wherein the profiled strip has a fastening web which is insertable into the groove and has a mushroom head shaped upper part adjoining the fastening web.

11. The document processing device as claimed in claim 10, wherein the upper part has a flatly rising flank, facing toward the aperture in an installed position, and wherein the upper part has a further flank lying opposite said rising flank and falling in the form of an arc of a circle towards the housing edge.

12. The document processing device as claimed in claim 6, wherein the profiled strip consists of natural rubber.

13. The document processing device as claimed in claim 11, wherein the housing edge has a radius, and wherein a radius of the arc of a circle of said flank corresponds to the radius of the housing edge.

14. The document processing device as claimed in claim 1, wherein said offset distance is in the range of 0.5 mm to 3.0 mm.

15. The document processing device as claimed in claim 12, wherein the strip has a hardness of 45 Shore A.

* * * * *